United States Patent [19]

Hanson et al.

[11] 4,246,824

[45] Jan. 27, 1981

[54] MUSICAL TOY

[75] Inventors: Steven P. Hanson, Naperville; Burton C. Meyer, Downers Grove, both of Ill.

[73] Assignee: Marvin Glass & Associates, Chicago, Ill.

[21] Appl. No.: 10,939

[22] Filed: Feb. 9, 1979

[51] Int. Cl.[3] ..... G10D 7/00

[52] U.S. Cl. ..... 84/336; 84/330; 46/179; 46/180

[58] Field of Search ..... 84/330, 336; 46/117, 46/118, 174, 178–181, 183, 187

[56] References Cited

U.S. PATENT DOCUMENTS

| | | | |
|---|---|---|---|
| 500,433 | 6/1893 | Schubert | 84/330 |
| 1,273,122 | 7/1918 | Adams | 46/117 |
| 2,487,546 | 10/1949 | Harrowe | 46/117 |
| 2,546,189 | 3/1951 | Keep et al. | 46/117 |
| 3,091,454 | 5/1963 | Sam | 46/179 |
| 4,083,742 | 4/1978 | Sugimoto | 46/117 |
| 4,114,501 | 9/1978 | Tanaka | 46/179 |

*Primary Examiner*—S. J. Witkowski
*Assistant Examiner*—Shelley Wade
*Attorney, Agent, or Firm*—Mason, Kolehmainen, Rathburn & Wyss

[57] ABSTRACT

A musical toy includes a plurality of tone producing, whistle-like structures arranged in pairs, each tone producing structure connected by a passageway to an hermetically sealed deformable hollow cavity or bulb. Each bulb includes a top generally flat surface having fixed surface area and a resilient, porous biasing agent which inflates the cavities to a predetermined size and configuration. When a cavity is depressed to a deflated position, compressed air is forced through connecting tubes into a sound generating structure thereby producing an audible, musical sound. Eight of the sound generating structures are provided in one apparatus to produce a unit having a full octave of notes. The sealed cavities are provided by selectively laminating a predetermined pattern of seal lines between two sheets of thermoplastic material such as soft, pliable vinyl sheets.

1 Claim, 4 Drawing Figures

Fig 1
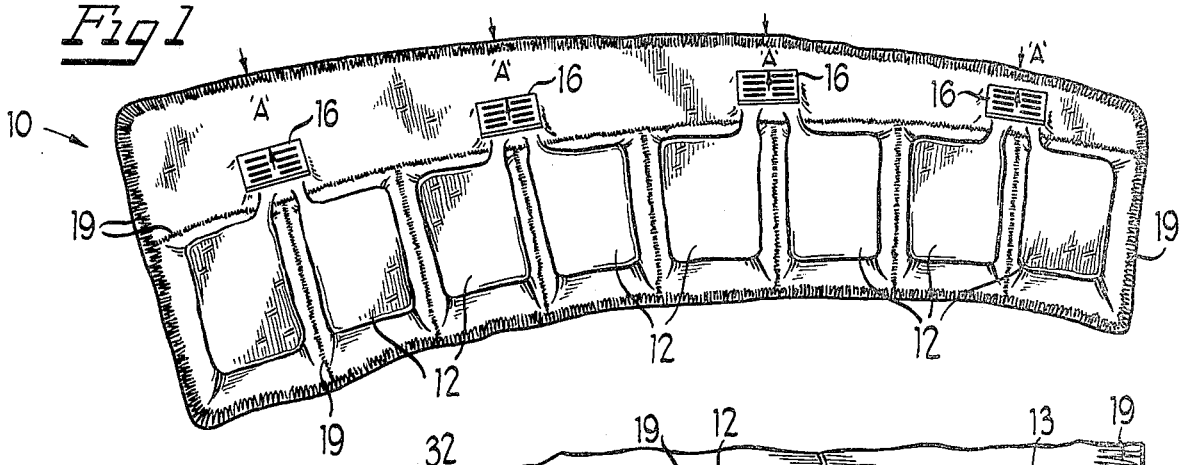
Fig 2
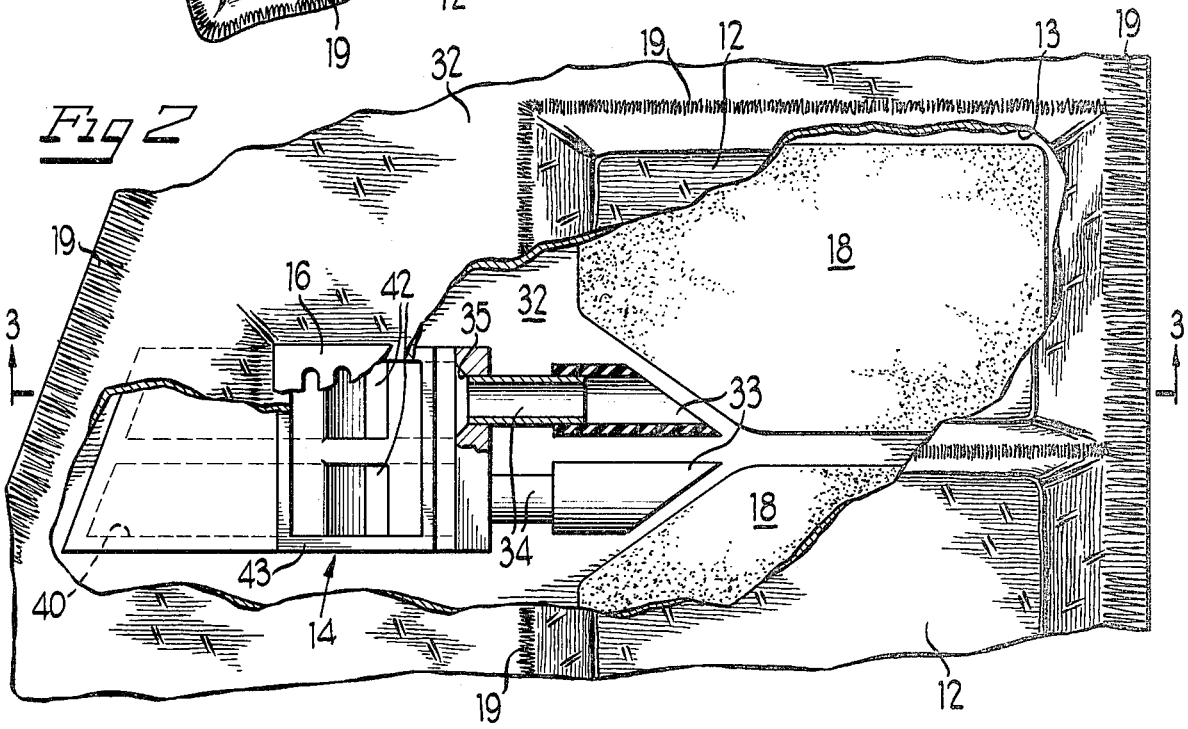
Fig 3
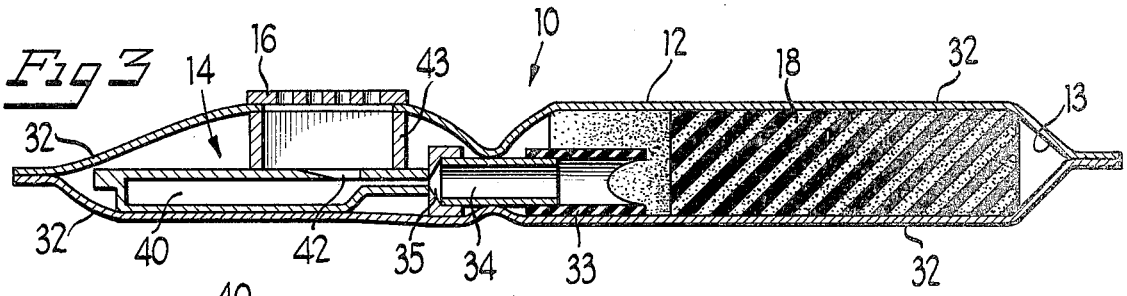
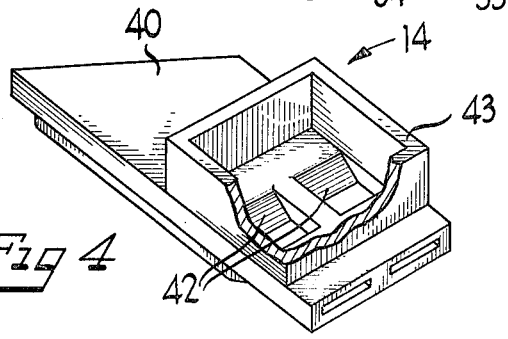
Fig 4

MUSICAL TOY

BACKGROUND OF THE INVENTION (1) Field of the Invention

This invention relates to a musical toy or wind instrument, and in particular to an apparatus which will produce a plurality of notes to teach the principles of music during play.

(2) Brief Description of the Prior Art

Many toys and instruments have been provided which utilize the forced passage of air past an opening or to vibrate a reed to create sound. Typical of these instruments are flutes, trombones, pipe organs and various other types of horns and woodwinds. Typically prior art toy instruments required that an individual blow into the instrument or that a compressor be used to supply forced air. The prior art devices were usually expensive, cumbersome and inoperable by small children.

SUMMARY OF THE INVENTION

The object of the present invention is to provide a lightweight, durable educational and inexpensive musical toy.

In accordance with the above and other objects, the present invention contemplates the provision of a sound generating toy which includes eight tone generating structures each having a configuration to produce an octave of notes. An inlet tube connected to each tone generator is connected to an hermetically sealed, deformable, hollow cavity. Each cavity or bulb is filled with open cell flexible foam which is porous and resilient in nature. The cavities are defined and formed by selective lamination of portions of superimposed sheets of material having at least some thermoplastic material content, such as vinyl sheets. The invention also includes vents integrally formed with the top of the tone generation for passing the generated sounds to the ambient.

Other objects, features and advantages of the present invention will become apparent from the following detailed description taken in conjunction with the accompanying drawings.

BRIEF DESCRIPTION OF THE DRAWINGS

FIG. 1 is a plan view of a musical toy made in accordance with the concepts of the present invention;

FIG. 2 is a partially fragmented plan view on an enlarged scale of a portion of the apparatus in FIG. 1;

FIG. 3 is a vertical section taken generally along lines 3—3 of FIG. 2;

FIG. 4 is a partially fragmented perspective of the sounding device utilized as a component of the musical toy of the present invention.

DESCRIPTION OF THE PREFERRED EMBODIMENT

A musical toy made in accordance with the concepts of the present invention is shown in FIG. 1, and generally designated by the reference numeral 10. The apparatus includes eight compressor pads 12 which, as described below, pump compressed air into sound generating, whistle structures, generally designated 14 as best shown in FIG. 4. The musical toy is manufactured by enclosing the sound generating mechanism between two layers of flexible thermoplastic material 32 and sealing the peripheries by application of heat or other sealing energy.

Referring more particularly to FIGS. 2 and 3, the compressor pads 12, which are the source of compressed air, are generally hollow cavities 13 which are filled with open cell foam blocks 18 which are porous and resilient, and therefore highly air absorbent. The foam blocks 18 are placed between the two layers of material 32, prior to heat sealing to form an air tight compartment enclosing each block 18.

The foam 18 biases the pads 12 to an inflated volumetric configuration as best illustrated by FIG. 3. Pressure may be used to deflate the pads 12 to a compressed position, thereby forcing air through a first flexible tube 33 into a smaller or rigid tube 34 which is in communication with an inlet 35 of the sound generator 14. When the pressure is removed from a pad 12, the resilient foam 18 restores the cavity 13 to its original position. The generally rectangular periphery of each pad 12 is sealed by the application of heat or other sealing energy, in the concentrated areas shown of the hatch marking 19 thereby securing the overlapping sheets of material 32 into a unified structure.

Referring more particularly to FIGS. 2, 3, and 4 it is seen that the sound generating, whistle device 14 has an elongated closed end cavity portion 40. These cavity portions 40 are eight in number, and vary in length so as to provide sounds of different pitch or frequency. Each two adjacent whistles are formed as one structure, as shown in FIG. 4. A generally rectangular wall 43 is provided at one end of the cavity 40, as shown. Two apertures 42 are provided within the walled area, on the upper surface of the whistles 14, at a point past the inlet 35. Each aperture has one angled surface as shown, so that, as air is directed past the opening, an audible sound is generated. In the invention shown, the cavities 40 are paired and embodied in four structures 14 having the end thereof terminating in an angle to provide the varied lengths of the cavities. A vent plate 16, as best illustrated in FIG. 1 is mounted on each wall 43 to permit the sound to escape.

As described above the cavities 40 are of varied length so as to provide a multiplicity of pitches or frequencies. In the preferred embodiment, the lengths of the cavities 40 are arranged, so that, as a player proceeds from one pad 12 to the next adjacent pad 12, a series of increasing or decreasing notes are produced. The decreasing distance 'A' between the vents 16 and the upper edge of the toy 10, as shown in FIG. 1, when moving from left to right, will produce a higher note as a user moves in this direction.

As mentioned above, the tubes 40 are of varied length so as to provide a multiplicity of pitches. In the preferred embodiment, the tubes 40 are arranged so that as a player proceeds from one pad 12 to the next adjacent pad 12, the ascending notes of the octave are produced. This device thereby teaches the user to distinguish the various harmonious sounds of an octave of notes, and at the same time imparts a sense of upward progression as the user proceeds from pad to pad.

Although the present invention has been described with reference to a single illustrative embodiment thereof, it should be understood that numerous other modifications and embodiments can be devised by those skilled in the art that will fall within the spirit and scope of the principles of this invention.

What is claimed as new and desired to be secured by Letters Patent is:

1. A musical toy, free of sharp edges and chewable extensions so as to be safe for young children, comprising:

a pair of opposed walls made of heat sealable, flexible material, said walls sealed together around peripheral edges to form an enclosed chamber;

at least eight juxtaposed cavities within said chamber defined by heat seals between said opposed walls, said cavities filled with a soft, resilient material, each of said cavities having a single opening into the remainder of said chamber; and at least eight whistles of different tones, together forming a complete musical octave, said whistles contained entirely within said chamber, each of said whistles being in exclusive fluid communication with one of said cavities through the opening in said cavity, arranged to form an ascending octave of tones from one cavity and associated whistle to the next adjacent cavity with its associated whistle, said whistles being secured together in pairs, each pair including two vibrating sounding elements, two sounding chambers for varying the pitch of the sound produced by said sounding element, having rigid walls, each of said chambers in communication with one of said sounding elements, and an amplifier chamber for amplifying the sound produced having rigid walls, in communication with both sounding elements, each of said whistles having an exit port in communication with said amplifier chamber through one of said walls for the release of air, said wall through which said exit port exits being secured to said whistle around said port.

* * * * *